US008448401B2

(12) United States Patent
Schaefer

(10) Patent No.: US 8,448,401 B2
(45) Date of Patent: May 28, 2013

(54) FIBER CEMENT BOARD SURFACE PRODUCT

(75) Inventor: Russ Schaefer, Manalapan, NJ (US)

(73) Assignee: Fiber Cement Foam Systems Insulation, LLC, Manalapan, NJ (US)

( * ) Notice: Subject to any disclaimer, the term of this patent is extended or adjusted under 35 U.S.C. 154(b) by 0 days.

(21) Appl. No.: 13/029,336

(22) Filed: Feb. 17, 2011

(65) Prior Publication Data

US 2012/0047837 A1 Mar. 1, 2012

Related U.S. Application Data

(60) Provisional application No. 61/305,255, filed on Feb. 17, 2010.

(51) Int. Cl.
*E04D 1/00* (2006.01)

(52) U.S. Cl.
USPC ..... 52/533; 52/309.12; 52/417; 52/460; 52/461; 52/478; 52/519; 52/748.1

(58) Field of Classification Search
USPC ..... 52/309.5, 309.12, 410, 417, 459–462, 52/478, 519, 521, 533, 540, 551, 747.1, 747.11, 52/748.1, 748.11, 169.5
See application file for complete search history.

(56) References Cited

U.S. PATENT DOCUMENTS

| | | | | |
|---|---|---|---|---|
| 1,655,494 | A * | 1/1928 | Cowan | 52/521 |
| 2,231,007 | A * | 2/1941 | Vane | 52/539 |
| 2,264,546 | A * | 12/1941 | Ochs | 52/521 |
| RE27,502 | E * | 10/1972 | Martin | 52/94 |
| 3,826,054 | A * | 7/1974 | Culpepper, Jr. | 52/309.8 |
| 3,998,021 | A | 12/1976 | Lewis | |
| 4,320,613 | A * | 3/1982 | Kaufman | 52/521 |
| 5,345,738 | A * | 9/1994 | Dimakis | 52/309.9 |
| 5,878,543 | A | 3/1999 | Mowery | |
| 6,263,574 | B1 | 7/2001 | Lubker, II et al. | |
| 6,355,700 | B1 | 3/2002 | Uekado et al. | |
| 6,418,610 | B2 | 7/2002 | Lubker, II et al. | |
| 6,688,073 | B2 | 2/2004 | VanderWerf et al. | |
| 6,715,240 | B2 | 4/2004 | Beck et al. | |
| 6,990,775 | B2 | 1/2006 | Koester | |
| 7,040,067 | B2 | 5/2006 | Mowery et al. | |
| 7,043,887 | B2 | 5/2006 | Van Ootmarsum | |
| 7,127,869 | B2 * | 10/2006 | Perry | 52/747.1 |

(Continued)

FOREIGN PATENT DOCUMENTS

| | | |
|---|---|---|
| WO | WO 99/00243 | 1/1999 |

*Primary Examiner* — Brian Glessner
*Assistant Examiner* — Brian D Mattei
(74) *Attorney, Agent, or Firm* — Gearhart Law, LLC

(57) ABSTRACT

A combined thermal insulation barrier and installation guide for fiber cement siding. A rectangular insulating board has a flat, rectangular back surface, and a front surface shaped to form a number of flat-faced, protruding ridges, aligned parallel to an edge of the rectangle. The cross-section, taken orthogonal to the ridges has a saw-tooth shape. When a standard-size, fiber cement plank is placed face-down on a face of a ridge with its edge abutting the short face of an adjacent ridge, and a second board is placed face-down on an adjacent ridge, the second board overlaps first board and lies flat on the first board. Once the shaped insulating board is aligned to a required orientation, and attached on a building surface, it serves as a positioning guide for attaching fiber cement boards. Left in the siding, the shaped, insulating board acts as insulation throughout the life of the siding.

13 Claims, 6 Drawing Sheets

U.S. PATENT DOCUMENTS

| | | | | |
|---|---|---|---|---|
| 7,188,454 | B2 | 3/2007 | Mowery et al. | |
| 7,836,652 | B2 * | 11/2010 | Futterman | 52/417 |
| 2003/0037499 | A1 * | 2/2003 | Coulton | 52/302.3 |
| 2003/0074854 | A1 * | 4/2003 | Nordgren et al. | 52/506.01 |
| 2006/0053740 | A1 * | 3/2006 | Wilson et al. | 52/745.09 |
| 2006/0075712 | A1 * | 4/2006 | Gilbert et al. | 52/520 |
| 2007/0011976 | A1 | 1/2007 | Mowery et al. | |
| 2007/0175159 | A1 | 8/2007 | Miniter | |
| 2007/0186501 | A1 | 8/2007 | Kuelker | |
| 2008/0313991 | A1 | 12/2008 | Chouinard | |
| 2009/0064599 | A1 * | 3/2009 | Bennett | 52/60 |
| 2009/0239430 | A1 * | 9/2009 | Egan et al. | 442/46 |

* cited by examiner

FIBER CEMENT BOARD SURFACE PRODUCT

CLAIM OF PRIORITY

This application claims priority to U.S. Ser. No. 61/305,255 filed Feb. 17, 2010, the contents of which are fully incorporated herein by reference.

FIELD OF THE INVENTION

The invention relates to the installation of cement board siding, and more particularly to products and processes related to installing cement board siding that produced improve thermal insulation and significantly reduce the time required for installation.

BACKGROUND OF THE INVENTION

Houses in America often have their exterior walls clad with siding to protect the predominately wooden construction from the elements. Vinyl siding has become particular popular over the last several decades as it is inexpensive, relatively easy to clean and relatively durable. However, in recent years, fiber cement siding has begun to replace vinyl siding. Fiber cement is a product made of sand, cement and cellulose. As a siding material, fiber cement has advantages over both wood and vinyl in that it is rot resistant, termite resistant and non-combustible. Because of these properties fiber cement siding has become widely used in bush fire regions of Australia, and is now becoming a material of choice for new construction in the US. Fiber cement siding can also be painted and can be made to look like wood. Its one significant disadvantage is that the fiber cement planks used in the siding are relatively heavy and need to be placed one at a time. Any method of making their alignment easier is, therefore, of great practical utility.

The system and method of this invention provide both increased thermal insulation and significantly simplify alignment of the planks. The simplified alignment significantly reduces the time to install the siding. By some estimates installation time may be reduced by as much as 40% through the use of the novel shaped insulating board of the present invention.

DESCRIPTION OF THE RELATED ART

The relevant prior art involving siding alignment and insulation products and processes include:

U.S. Patent Publication Number 2009/0019814 is directed to a panelized cladding system including a plurality of battens securable to a building structure, each batten having a structure engaging surface and an integrally formed finish ready panel supporting surface and, fiber cement cladding panels are secured to or through the battens such that the finish ready panel supporting surface of each batten forms an external recessed surface of an express joint formed thereon United States Patent Application 20090283201 relates to reinforced fiber cement article comprising a fiber cement piece and a reinforcing fixture bonded to a portion of the fiber cement piece for improving the performance, strength and durability of the fiber cement piece. The reinforcing fiber cement article could be used as or in conjunction with a siding plank assembly, which further comprises an interlocking feature that allows the siding plank to be stacked with other siding planks in a manner such that a uniform and deep shadow line is created. The interlocking feature sets the gauge of the exposed plank face and allows for leveling of the plank during installation. The reinforcing fixture could also serve as a thick butt piece or a plastic spline that produces a deep shadow line. A cementitious adhesive is used to bond the reinforcing fixture to the fiber cement piece.

U.S. Pat. No. 6,418,610 relates to a method for using a support backer board system and siding. The support backer board system comprises at least a first layer. The first layer is made from a material selected from the group consisting of alkenyl aromatic polymers, polyolefins, polyethylene terephthalate, polyesters, and combinations thereof. The board system is thermoformed into a desired shape with the desired shape being generally contoured to the selected siding. The siding is attached to the board system so as to provide support thereto. In one process, the siding may be vinyl.

U.S. Pat. No. 6,067,770 is directed to a method for using a foam condensation board system in a building according to one embodiment comprises the steps of: providing a foam condensation board system, providing a building having a roof and a roof supporting structure, and installing the foam condensation board system to the roof supporting structure. The foam condensation board system comprises at least a first layer, a second layer, a third layer, a fourth layer, and a fifth layer, which are various foam/alkenyl aromatic polymers. A method of using a foam condensation board system in a building according to another embodiment comprises the steps of: providing a foam condensation board system, providing a building having a side wall and a side wall supporting structure, and installing the foam condensation board system to the side wall supporting structure.

U.S. Pat. No. 5,345,738 describes an insulating sheathing panel has an insulating core, such as foam, sandwiched between PMDI impregnated cover sheets. The resulting panels offer structural reinforcement as well as insulating qualities to a building framework.

U.S. Pat. No. 5,170,603 is a panel wall system is based on panels, each of which includes a sheet of high density fiberboard, a vapor barrier on the back surface of the fiberboard sheet and a sheet of substantially rigid polymeric material adhesively secured to the front face of the fiberboard sheet, the polymeric sheet having a thickness of not less than about 0.022 inch. The other components of the system are various trims and moldings.

U.S. Pat. No. 3,826,054 describes a building sheathing having insulating qualities and adapted to be attached to the outside surfaces of the building studding to form a permanent insulation for the building. In one embodiment, the outer surface of the sheathing is so contoured as to mate with a building exterior wall finish such as an aluminum or vinyl siding; and in addition to providing a snap-on attachment of the siding to the sheathing, support and proper alignment of the exterior wall siding is provided. In a second embodiment, the sheathing has an outer surface contoured to mate with a mounting sheet, fabricated from a suitable material, such as aluminum, having a plurality of horizontally disposed, vertically spaced channels adapted to support a face brick.

Various implements are known in the art, but fail to address all of the problems solved by the invention described herein. One embodiment of this invention is illustrated in the accompanying drawings and will be described in more detail herein below.

SUMMARY OF THE INVENTION

The present invention relates to an apparatus that may form an insulating barrier behind a fiber cement siding and the building surface it is protecting, and may also act as an installation guide that aids in attaching fiber cement planks or boards that form the siding.

In a preferred embodiment, a rectangular insulating board, made of a suitably thermal insulating material, may have a substantially flat, rectangular back surface, and a front surface shaped to form a number of flat-faced, protruding ridges. The protruding ridges may be aligned substantially parallel to an edge of the rectangle. A cross-section, taken orthogonal to the alignment of the protruding ridges, may have a saw-tooth shape.

The ridges may be shaped and sized so that the following may be done. A standard-size, fiber cement plank, or board, may be placed face-down on a long face of a protruding ridge of the shaped insulating board. The fiber cement board may be positioned to have its long edge abutting the short face of an adjacent protruding ridge. A second fiber cement board of a similar size may then be placed face-down on a long face of the adjacent protruding ridge. When the second fiber cement board 110 is positioned to have it long edge abut the short face of the next adjacent ridge, the second board may then overlap the first fiber cement board. The overlap may be such that the underside face of the overlap of the second board lies flat on the upper face of the first board.

Such a shaped insulating board may be used to both aid in aligning the fiber cement board when attaching them to a building surface, such as, but not limited to, an external wall of a house, to form a protective siding.

The shaped insulating board may be aligned on the wall to a required orientation. The required orientation may be that orientation in which the protruding ridges are aligned in there same direction as the desired orientation the length of the fiber cement board when it is attached.

Once the shaped insulating board is attached to the wall, it may then serve as a guide for positioning the fiber cement board. The fiber cement board may, for instance, be positioned by abutting its long side against a short edge one of the protruding ridges, with the fiber cement board's face against the long face of an adjacent protruding ridge. The fiber cement board is then correctly aligned and may be slid along the ridge edge until it is in place for attaching to the wall. The attachment may, for instance, be by means of a fastener such as, but not limited to, nails, screw, bolts or some combination thereof.

Therefore, the present invention succeeds in conferring the following, and others not mentioned, desirable and useful benefits and objectives.

It is an object of the present invention to provide additional thermal insulation to houses.

It is another object of the present invention to provide a tool for rapid positioning of fiber cement boards.

Yet another object of the present invention is to provide quicker, and therefore less expensive, installation of fiber cement siding.

DESCRIPTION OF THE PREFERRED EMBODIMENTS

Figure 1:
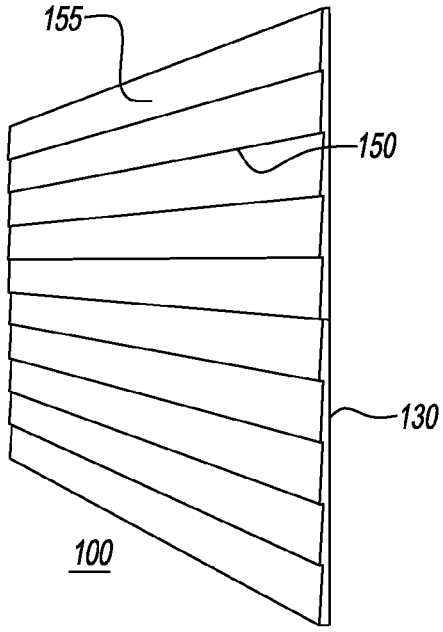
FIG. 1 shows an isometric view of a preferred embodiment of a shaped insulating board of the present invention.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 shows an isometric view of a preferred embodiment of a shaped insulating board of the present invention.

The shaped insulating board 100 may have a rectangular, substantially flat back surface 130 (not shown in FIG. 1). On the front surface 155, the shaped insulating board 100 may be shaped to have a series of substantially identical, flat-faced protruding ridges 150. As discussed in more detail below the details of the size and shape of these protruding ridges 150 may be determined largely by the dimensions of the standard fiber cement boards 110 typically used for exterior wall siding on, for instance, domestic houses.

The shaped insulating board 100 may be made from any suitable thermal insulator that is also sufficiently rigid to support standard-sized fiber cement boards 110 during installation. Suitable materials are insulators such as, but not limited to, polyolefin, polyethylene terephthalate, polyester, alkenyl aromatic polymer, polystyrenic resin and polystyrene, or some combination thereof.

The shaped insulating board 100 may be shaped by a method suitable to the material used including hot wire forming techniques such as, but not limited to preformed wire manufacture in which a preformed wire is attached to a handle and an operator manually guides the wire through the foam to cut freeform shapes or a template-guided manual table method or some combination thereof. The shaped insulating board 100 may also be made using molding techniques.

Figure 2:
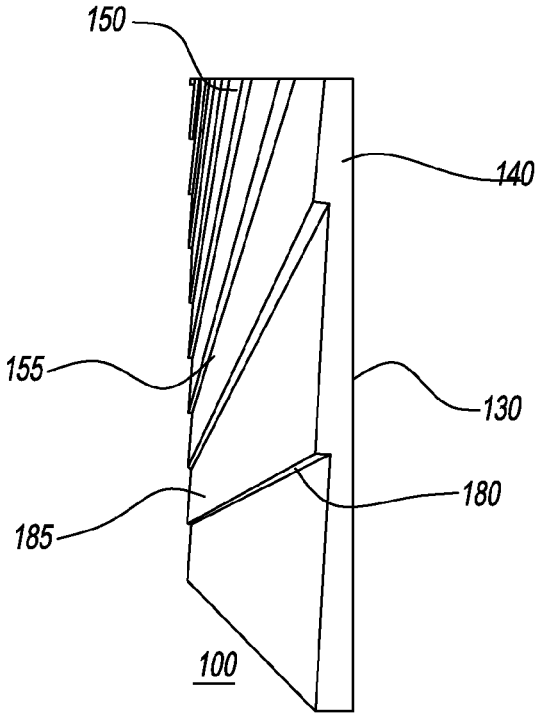
FIG. 2 shows a cross-sectional view of a preferred embodiment of a shaped insulating board of the present invention.

FIG. 2 shows a cross-sectional view of a preferred embodiment of a shaped insulating board of the present invention.

The front surface 155 of the shaped insulating board 100 has a number of protruding ridges 150 on it. Seen in cross-section along a line substantially orthogonal to the alignment to the protruding ridges 150, the shaped insulating board 100 has a thickness that fairly closely approximate a saw-tooth shaped cross-section 140.

The protruding ridges 150 have both a long face 185 and a short face 180.

Figure 3:
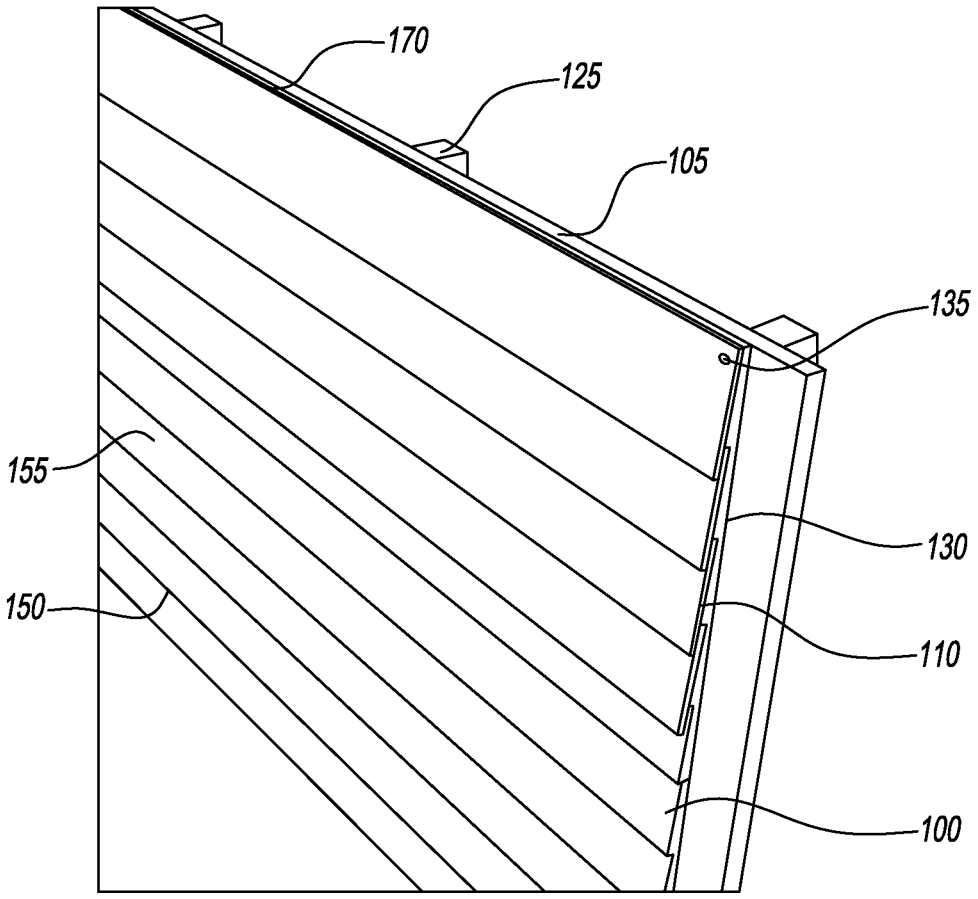
FIG. 3 shows an isometric view of fiber cement boards being attached to a building surface using a shaped insulating board of the present invention both for alignment and insulation.

FIG. 3 shows an isometric view of fiber cement boards being attached to a building surface using a shaped insulating board of the present invention both for alignment and insulation.

In a conventional mode of creating siding for an exterior wall, the fiber cement board 110 would be attached directly to the building surface 105, typically using fastening elements 135 such as, but not limited to, nails or screws. Attaching the fastening elements 135 through the fiber cement board 110 and building surface 105 to the frame work of studs 125 is the most desirable way of attaching the fiber cement board 110 to the building surface 105.

The system and method of the present invention is shown in FIG. 3 in which a fiber cement board siding is being created using a shaped insulating board 100.

The shaped insulating board 100 may, for instance, be attached to the building surface 105 using a suitable attachment means such as, but not limited to, glue, adhesive, double-sided tape, nails, screws or some combination thereof.

The shaped insulating board 100 may be attached to the building surface 105 with the protruding ridges 150 on the front surface 155 aligned in the orientation that is desired for the long side 170 of the fiber cement board 110.

Once the shaped insulating board 100 is attached in place in the required orientation, the fiber cement boards 110 may be added. This may, for instance, be done by positioning the fiber cement board 110 by placing an inner face 112 of the fiber cement board 110 against the long face 185 of the shaped insulating board 100. The long-side 170 of the fiber cement board 11 may then be abutted against a short face 180 of the protruding ridge, and the board slid horizontally until the ends are the required position.

Once the fiber cement board 110 is positioned, it may be attached to the building surface 105. The attachment may, for instance, be effected by suitable fastening elements 135 such as, but not limited to, nails, screws, bolts or some combination thereof. The fastening elements 135 are preferably place so as to extend into the studs 125. Such studs 125 are typically place at regular intervals in housing construction to conform to local building codes. Typical requirements may, for instance, be having the studs 125 place at 16 inch, or 25 inch intervals.

In one embodiment of the present invention, the front surface 155 of the shaped insulating board 100 may be marked with guides that reflect required stud spacing.

In attaching the fiber cement board 110 to the building surface 105, the shaped insulating board 100 is also securely attached, sandwiched between the two and substantially completely filling what would otherwise be a void between the overlapping fiber cement boards 110 and the building surface 105. By filling this void, the shaped insulating board 100 may provide additional thermal insulation to the siding, and therefore, to the house to which the siding may be attached.

Figure 4:
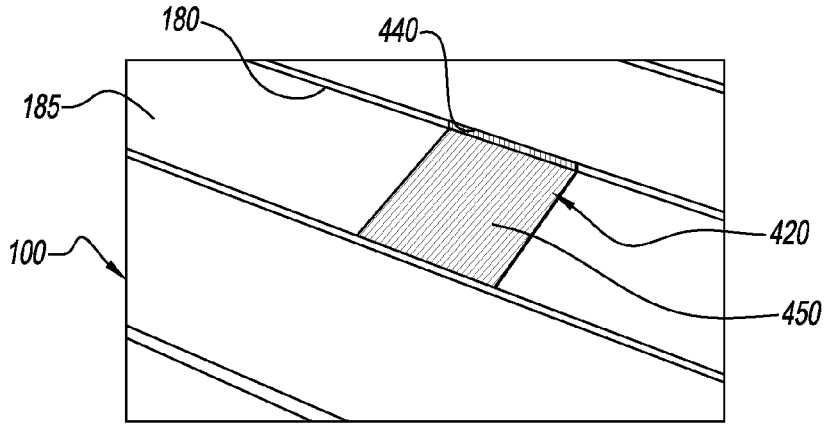
FIG. 4 shows an isometric view of a shaped flashing element of the present invention.

FIG. 4 shows an isometric view of a shaped flashing element of the present invention.

In FIG. 4 the shaped flashing element 420 is shown in place against a gap 430 between shaped insulating boards. The shaped flashing element 420 may straddle the gap between a first shaped insulating board 100 and a second shaped insulating board 410 so as to improve the moisture resistance of the thermal barrier.

The shaped flashing element 420 may, for instance, be fashioned from a single rectangle of malleable material such as, but not limited to, copper, bronze, tin, steel, aluminum or some combination thereof. The single rectangle may be formed into a first rectangle 440 and a second rectangle 450. The first rectangle 440 may have a short edge substantially equal in length to the width of the short face 180 of the protruding ridge 150. The second rectangle 450 may have a long edge substantially equal in length to the width of the long face 185 of the protruding ridge 150 of the shaped insulating board 100. The short edge of the second rectangle 450 of the shaped flashing element 420 may have a length substantially equal to the long edge of first rectangle 440. The long edge of shaped flashing element 420 may form a substantially contiguous join with the short edge of the second rectangle 450. The faces of the rectangles may be angled to match the concave angle between adjacent protruding ridges 150 of the shaped insulating board 100.

The shaped flashing element 420 may, for instance, be made by a process such as, but not limited to, molding, machining, bending or some combination thereof. The shaped flashing element 420 may for instance be made from any suitable water resistant material such as, but not limited to, plastic, metal, polythene or some combination thereof.

Figure 5:
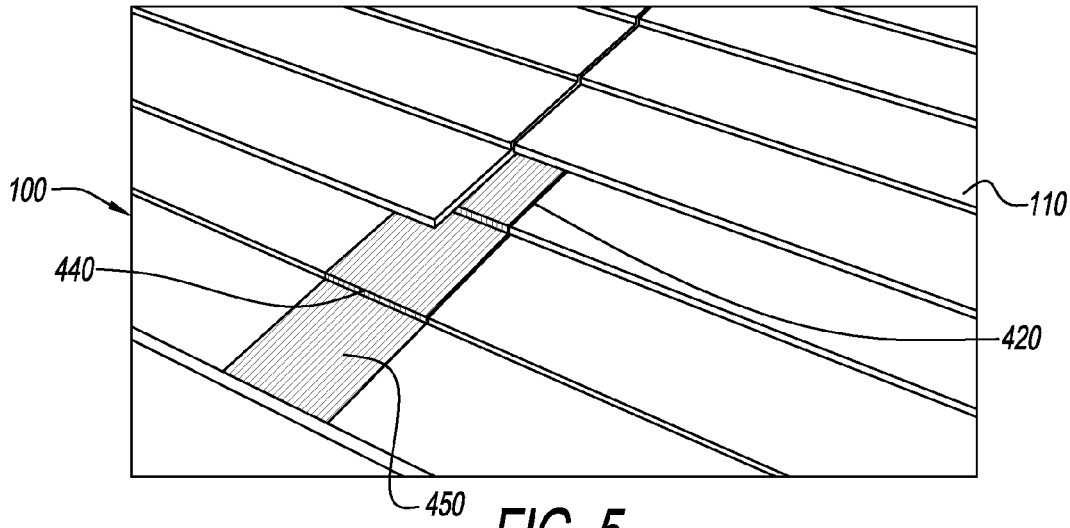
FIG. 5 shows an isometric view of a shaped flashing element beneath a fiber cement board.

FIG. 5 shows an isometric view of a shaped flashing element beneath a fiber cement board.

FIG. 5 show a similar situation to FIG. 4 in that a shaped flashing element 420 is covering a gap 430 between shaped insulating boards. As shown in FIG. 5, a next step in constructing the siding may be to attach a first fiber cement board 110 over the shaped flashing element 420. Once the fiber cement boards 110 are secured, the shaped flashing element 420 may be held in place, sandwiched between the fiber cement board 110 and the shaped insulating board 100. Because the shaped flashing element 420 has the gap first rectangle 440 angled with respect to the second rectangle 450, the shaped flashing element 420 may stay in place without any fastening elements 135 passing directly through it.

One of ordinary skill in the art will readily appreciate that although the shaped flashing element 420 has been illustrated as cover a gap 430 between shaped insulating boards, the shaped flashing element 420 would also be effective in closing a gap between two shaped insulating boards 100 that are butted together at the same height.

In a preferred embodiment, the shaped flashing element 420 may have a width in a range of 0.5 to 12 inches and a thickness in a range of less than 0.5 inches. More preferably, the shaped flashing element 420 may have a width in a range of 1 to 3 inches and a thickness in a range of less than 0.125 inches.

Figure 6:
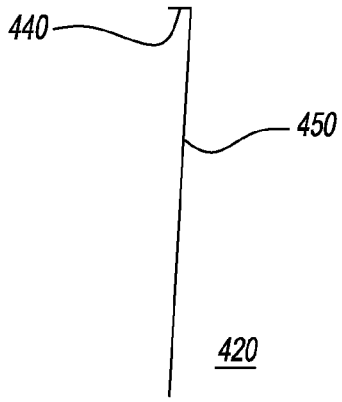
FIG. 6 shows a schematic side view of a shaped flashing element

FIG. 6 shows a schematic side view of a shaped flashing element having a characteristic "L" shaped cross-section. From FIG. 6 it may be possible to infer that the first rectangle 440 may be angled with respect to the second rectangle 450 a the same angle as the short face 180 of one protruding ridge 150 makes with the long face 185 of an adjacent protruding ridge 150.

Figure 7:
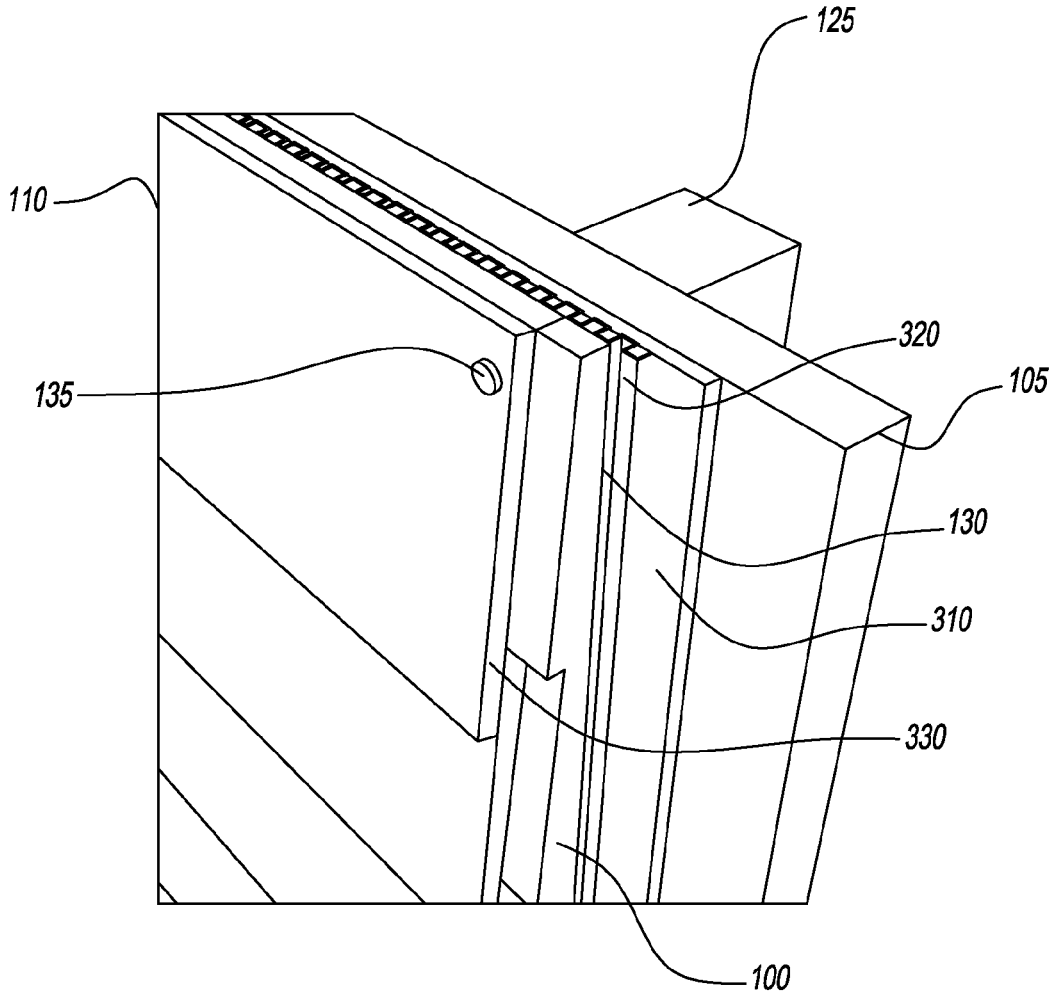
FIG. 7 shows an isometric, partially cut away view of an installed fiber cement siding incorporating a drainage panel and a water proof sheet.

FIG. 7 shows an isometric, partially cut away view of an installed fiber cement siding incorporating a drainage panel and a water proof sheet.

In this embodiment of the invention, there may be a drainage panel 320 and a water proof sheet 310 sandwiched between the shaped insulating board 100 and the building surface 105.

The entire sandwich may be held in place by the fastening elements 135 that secure the fiber cement boards 110 to the building surface 105. The fastening elements 135 are preferably located so as to penetrate the studs 125.

The water proof sheet 310 may be made of any suitable waterproof or water-resistant for creating a vapor barrier such as, but not limited to, aluminum foil, paper-backed aluminum, polyethylene plastic sheet, a metalized film, or some combination thereof.

The drainage panel 320 may be any suitable material having channels that may run vertically down the building surface 105.

FIG. 7 clearly shows how the shaped insulating board 100 is sized and shaped so that there is a region of overlap 330 between adjacent fiber cement boards 110. The size and shope of the shaped insulating board 100 may ensure that at the region of overlap 330, the underside face of the one fiber cement board 110 lies substantially flat on the upper face of the adjacent fiber cement board 110.

The region of overlap 330 may be in the range of a range of 0.25 inches to 6 inches, and is more preferably in a range of 0.5 inches to 2 inches.

Figure 8:
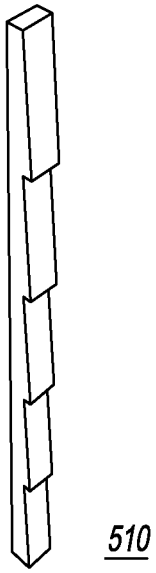
FIG. 8 shows an isometric view of an end-piece.

FIG. 8 shows an isometric view of an end-piece. The end-piece 510 may serve to seal the edges of a siding installation.

Figure 9:
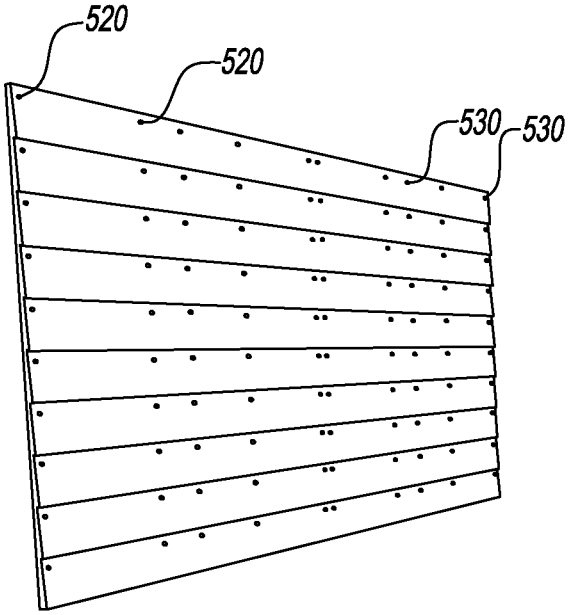
FIG. 9 shows an isometric view of the front side of a preferred embodiment of a shaped insulating board having stud markings for two standard stud spacings.

FIG. 9 shows an isometric view of the front side of a preferred embodiment of a shaped insulating board having stud markings for two standard stud spacings.

In FIG. 9, the shaped insulating board 100 has been pre-marked with both 16 inch stud markings 520 and 24 inch stud markings 530. 16 inch and 24 inch stud spacings are both common requirements of town building codes within the US. The stud markings may, for instance, take the form of an indicia such as, but not limited to, a partial pilot hole of a particular diameter, a printed reference point, a line or some combination thereof.

As illustrated in FIG. 9, there may be a series of marking for a multiplicity of stud spacings, each set of spacings being distinguished by a characteristic such as, but not limited to, the diameter or depth of a full or partial pilot hole, a color or size of a printed indicia or some combination thereof.

Figure 10:
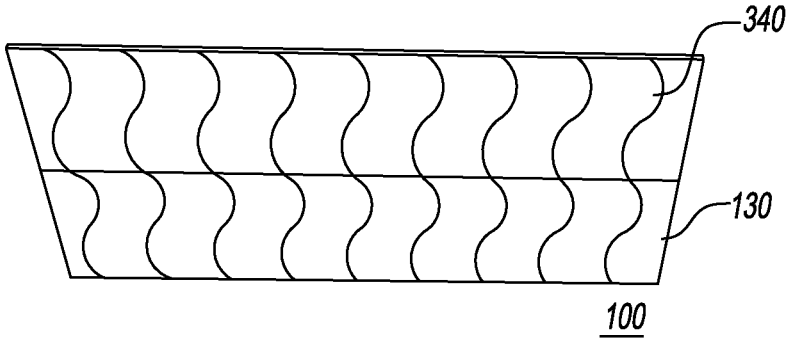
FIG. 10 shows an isometric view of the flat back surface of a shaped insulating board of the present invention having a series of drainage channels.

FIG. 10 shows an isometric view of the flat back surface of a shaped insulating board of the present invention having a series of drainage channels.

The substantially flat back surface 130 of a shaped insulating board 100 is shown in FIG. 10. In a preferred embodiment, the flat back surface 130 of the shaped insulating board 100 may be shaped with at least one drainage channels 340. The drainage channels 340 may, for instance, be one or more grooves running predominantly in a direction perpendicular to the orientation of the protruding ridges 150 on the front surface 155 of the shaped insulating board 100. The objective of the drainage channels 340 is to provide a drainage path for any moisture that may accumulate between the shaped insulating board 100 and the building surface 105.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A combined insulation and installation guide apparatus for attaching fiber cement boards to a building surface to form an installed fiber cement siding, comprising:

at least two shaped insulating boards to be installed on a building surface horizontally or vertically adjacent to each other and leaving a vertical or horizontal gap between the boards, said boards comprised of a thermally insulating material and comprising:

a substantially flat, rectangular back surface;

a cross-section, taken substantially parallel to a first edge of said shaped insulating board, having a substantially saw-tooth shape;

a plurality of substantially flat-faced, protruding ridges on a front surface, said protruding ridges being aligned substantially orthogonal to said first edge, said ridges being shaped and sized such that when a first fiber cement board of a standard size is placed face-down on a long face of a first protruding ridge with a long edge of said first fiber cement board abutting a short face of an adjacent protruding ridge, a second fiber cement board of said same standard size placed face-down on a long face of said adjacent protruding ridge will overlap said first fiber cement board, with the underside face of the overlap of said second fiber cement board lying substantially flat on the upper face of said first fiber cement board; and a multitude of shaped flashing elements for covering the vertical or horizontal gap between the insulating boards and being made of a waterproof material and consisting of a first rectangle having a short edge substantially equal in length to the width of said short face of said protruding ridge of said shaped insulating board;

a second rectangle having a long edge substantially equal in length to the width of said long face of said protruding ridge of said shaped insulating board, and a short edge having a length substantially equal to a long edge of said first rectangle; and wherein said long edge of said first rectangle forms a substantially contiguous join with said short edge of said second rectangle, and the faces of said rectangles are angled to match an angle between adjacent protruding ridges of said shaped insulating boards, such that said flashing is sandwiched between said fiber cement board and said shaped insulating board and held in place without fastening material or overhanging elements and said multitude of flashing elements covers the gap between the insulating boards.

2. The apparatus of claim 1 wherein said shaped flashing element has a width in a range of 0.5 to 12 inches and a thickness in a range of less than 0.5 inches.

3. The apparatus of claim 1, wherein said overlap is in a range of 0.25 inches to 6 inches.

4. A method of attaching fiber cement boards to a building surface, comprising the steps of:

a) providing at least one fiber cement board having a length substantially greater than a width;

b) aligning at least two shaped insulating boards to a required orientation, said shaped insulating boards having a rectangular, substantially flat back surface and a substantially saw-tooth shaped cross-section thereby creating a plurality of substantially flat faced, protruding ridges on a front surface of said shaped insulating boards, adjacent ridges having a short face of one ridge joined in an angle to a long face of another ridge; and where, in said required orientation, said protruding ridges align in a desired orientation of said length of said fiber cement board; and where the at least two shaped insulating boards are adjacent to each other vertically or horizontally and leaving a gap between said shaped insulating boards;

c) covering the gap between the vertically or the horizontally adjacent insulating boards with a multitude of shaped flashing elements, said shaped flashing elements made of a waterproof material and consisting of:

a first rectangle having a short edge substantially equal in length to the width of the short face of the protruding ridge of the shaped insulating board;

a second rectangle having a long edge substantially equal in length to the width of the long face of the protruding ridge of the shaped insulating board, and a short edge having a length substantially equal to a long edge of the first rectangle; and wherein the long edge of the first rectangle forms a substantially contiguous join with the short edge of the second rectangle, and the faces of said rectangles are angled to match the angle of the joint of the short and the long face of adjacent protruding ridges of the shaped insulating board;

d) fixing said shaped insulating board against said building surface;

e) positioning said fiber cement board by abutting a long side of said fiber cement board against a short face of said protruding ridges of said shaped insulating board; and f) attaching said fiber cement board against said front surface of said shaped insulating board and to said building surface, such that said flashing is sandwiched between said fiber cement board and said shaped insulating board and held in place without fastening material or overhanging elements.

5. The method of claim 4 wherein said shaped insulating boards are shaped by utilizing a hot-wire method.

6. The method of claim 4 wherein said shaped insulating boards are shaped by molding an insulating material.

7. The method of claim 4, further comprising the steps of fixing a water proof sheet to said building surface; attaching a drainage panel adjacent to said water proof sheet said drainage panel having substantially vertically oriented ridges and grooves on both sides of the panel and fixed to said building surface prior to aligning said shaped insulating boards.

8. The method of claim 4, wherein said flat back surface of said shaped insulating boards further comprise substantially vertically running grooves, each of said grooves being parallel to each other.

9. The method of claim 8 wherein said shaped insulating board has multiple stud markings on the front surface, said stud markings forming vertical lines 16 or 24 inches apart from each other.

10. The method of claim 4 wherein fixing said shaped insulating board against said building surface comprises using one of glue and a strip of double sided tape, or a combination thereof.

11. The method of claim 4 wherein attaching said fiber cement board to said building surface comprises using one of a nail and a screw, or a combination thereof.

12. The method of claim 4, wherein said shaped insulating board is comprised of one of an alkenyl aromatic polymer, a polystyrenic resin and polystyrene, or a combination thereof.

13. The method of claim 4, further comprising attaching an end-piece to said building surface, wherein the end-piece is aligned vertically with the shaped insulating boards and has a saw tooth shaped cross section.

* * * * *